US007406931B2

(12) United States Patent
Nakamura

(10) Patent No.: US 7,406,931 B2
(45) Date of Patent: Aug. 5, 2008

(54) CONTROL APPARATUS FOR INTERNAL COMBUSTION ENGINE

(75) Inventor: Kiyoharu Nakamura, Seto (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 116 days.

(21) Appl. No.: 11/437,749

(22) Filed: May 22, 2006

(65) Prior Publication Data

US 2007/0012268 A1 Jan. 18, 2007

(30) Foreign Application Priority Data

Jul. 15, 2005 (JP) ..... 2005-207194

(51) Int. Cl.
*F01L 1/34* (2006.01)

(52) U.S. Cl. ..... 123/90.15; 123/90.11; 123/90.16; 123/347; 123/406.41; 123/435

(58) Field of Classification Search ..... 123/90.11, 123/90.16, 90.27, 90.31, 90.15, 90.17, 345, 123/346, 347, 348, 406.41, 406.58, 435
See application file for complete search history.

(56) References Cited

U.S. PATENT DOCUMENTS

| | | | | |
|---|---|---|---|---|
| 5,024,191 | A * | 6/1991 | Nagahiro et al. | 123/198 D |
| 5,183,011 | A * | 2/1993 | Fujii et al. | 123/1 A |
| 6,073,596 | A | 6/2000 | Kemper | |
| 6,564,763 | B2 * | 5/2003 | Shiraishi et al. | 123/90.15 |
| 6,691,653 | B2 * | 2/2004 | Denz | 123/90.15 |
| 6,920,851 | B2 * | 7/2005 | Machida et al. | 123/90.16 |
| 7,004,125 | B2 * | 2/2006 | Asada | 123/90.15 |
| 2004/0182341 | A1 | 9/2004 | Machida et al. | |
| 2005/0284435 | A1 | 12/2005 | Baeuerle | |

FOREIGN PATENT DOCUMENTS

| | | |
|---|---|---|
| DE | 19733137 | 2/1999 |
| DE | 19814803 | 10/1999 |

(Continued)

OTHER PUBLICATIONS

German Language Version of German Office Action, Appl. No. 10 2006 000 338.1-26, issued May 16, 2007.

(Continued)

*Primary Examiner*—Ching Chang
(74) *Attorney, Agent, or Firm*—Kenyon & Kenyon LLP

(57) ABSTRACT

An internal combustion engine is provided with a plurality of valves, including a main driving valve and a driven valve, each of which can be lifted in response to an instruction from a control apparatus, and a lift sensor which detects a lift amount of the main driving valve. The control apparatus controls the lift of the driven and main driving valves based on an output of the lift sensor. The engine may also include a proximity sensor which detects whether the position of the driven valve is within a predetermined range, and a crank angle sensor. The control apparatus monitors the output of the proximity sensor to determine whether the driven valve is out of synchronization with respect to the crank angle, and performs an initial driving control that initializes the positions of the driven and main driving valves corresponding to the driven valve when loss of synchronization is detected.

7 Claims, 17 Drawing Sheets

FOREIGN PATENT DOCUMENTS

| | | |
|---|---|---|
| DE | 10010048 | 5/2001 |
| DE | 10024997 | 11/2001 |
| DE | 102004030452 | 1/2006 |
| JP | A 2001-152881 | 6/2001 |
| JP | A 2003-328787 | 11/2003 |

OTHER PUBLICATIONS

English Translation of German Office Action, Appl. No. 10 2006 000 338.1-26, issued May 16, 2007.

* cited by examiner

CONTROL APPARATUS FOR INTERNAL COMBUSTION ENGINE

INCORPORATION BY REFERENCE

The disclosure of Japanese Patent Application No. 2005-207194 filed on Jul. 15, 2005, including the specification, drawings and abstract is incorporated herein by reference in its entirety.

BACKGROUND OF THE INVENTION

1. Field of the Invention

The invention relates to a control apparatus for an internal combustion engine. More particularly, the invention relates to a control apparatus for an internal combustion engine, which controls at least one of an intake valve and an exhaust valve.

2. Description of the Related Art

With respect to a related electromagnetically driven valve of an internal combustion engine, Japanese Patent Application Publication No. JP-A-2001-152881, for example, discloses an abnormality diagnosing device for an electromagnetically driven valve. The described abnormality diagnosing device compares the outputs of two lift sensors for intake valves or exhaust valves, which are simultaneously driven under the same driving conditions in each cylinder, and determines that an abnormality is present when the difference between the two sensor outputs exceeds a maximum allowable error.

In the structure described, however, a lift sensor is provided for each valve, which is disadvantageous in terms of cost.

On the other hand, if valve control is performed without using a lift sensor, the control may be inappropriately executed due to disturbances such as fluctuations that occur in vehicle load. Such disturbances significantly affect the optimal opening and closing of the exhaust valves in particular.

SUMMARY OF THE INVENTION

In view of the foregoing problem, the invention thus provides a control apparatus for an internal combustion engine that is less costly to manufacture.

Accordingly, one aspect of the invention relates to a control apparatus for an internal combustion engine provided with a plurality of valves, including a main driving valve and a driven valve, and a lift sensor that detects a lift amount of the main driving valve. The control apparatus includes a controller that controls the lift of the main driving valve and the driven valve based on the output of the lift sensor.

According to the control apparatus for an internal combustion engine described above, the number of lift sensors used is reduced, thereby reducing the manufacturing cost.

Another aspect of the invention relates to a control apparatus for an internal combustion engine provided with a plurality of sensors, each of which can be lifted, and a pressure sensor that detects an internal pressure of a cylinder. The control apparatus includes a controller that controls the lift of at least one valve, from among the plurality of valves, based on the output of the lift sensor.

According to the control apparatus for an internal combustion engine described above, lift sensors are not necessary, which reduces the manufacturing cost.

BRIEF DESCRIPTION OF THE DRAWINGS

The features, advantages thereof, and technical and industrial significance of this invention will be better understood by reading the following detailed description of the exemplary embodiments of the invention, when considered in connection with the accompanying drawings, in which.

DETAILED DESCRIPTION OF THE EXEMPLARY EMBODIMENTS

Figure 1:
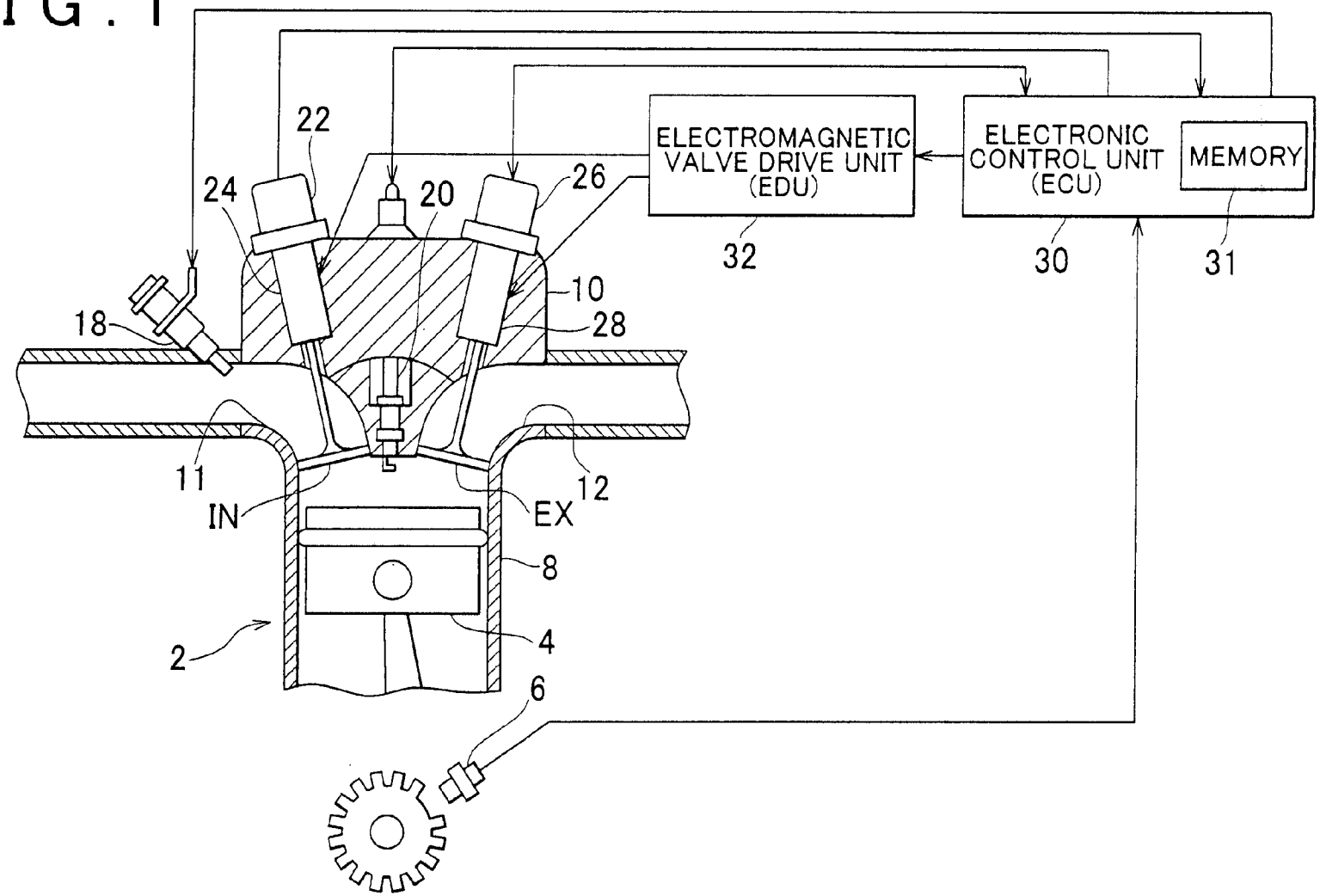
FIG. 1 is a view schematically illustrating the configuration of an overall engine.

In the following description and the accompanying drawings, the present invention will be described in more detail with reference to exemplary embodiments. The same or corresponding portions will be denoted by the same reference numerals and descriptions thereof will not be repeated.

FIG. 1 is a view schematically illustrating the configuration of an overall engine. Referring to the drawing, an engine 2, i.e., an internal combustion engine, includes a cylinder block 8; a cylinder head 10; a piston 4, which reciprocates in each cylinder; an electromagnetically driven intake valve IN provided in the intake port of each cylinder, and an electromagnetically driven exhaust valve EX provided in the exhaust port 12 of each cylinder. The intake valve IN and exhaust valve EX may be provided in sets of two each, for example, for each cylinder.

The intake valve IN and exhaust valve EX are each driven by an electromagnetic actuator 24 and 28, respectively. A sensor 22 is used to detect the driving state of the intake valve IN, while another sensor 26 is used to detect the driving state of the exhaust valve EX.

A fuel injection valve 18 that injects fuel is provided near the intake port 11. A crank angle sensor 6 is mounted on the cylinder block 8 of the engine 2. The outputs of these various sensors are input to an electronic control unit (ECU) 30. The ECU 30 controls the injection timing and amount of fuel injected by the fuel injection valve 18, as well as the ignition timing of a spark plug 20. The ECU 30 also instructs an electromagnetic drive unit (EDU) 32 as to the valve opening timing of the electromagnetic actuators 24 and 28 which drive the intake valve IN and the exhaust valve EX, respectively.

Figure 2:
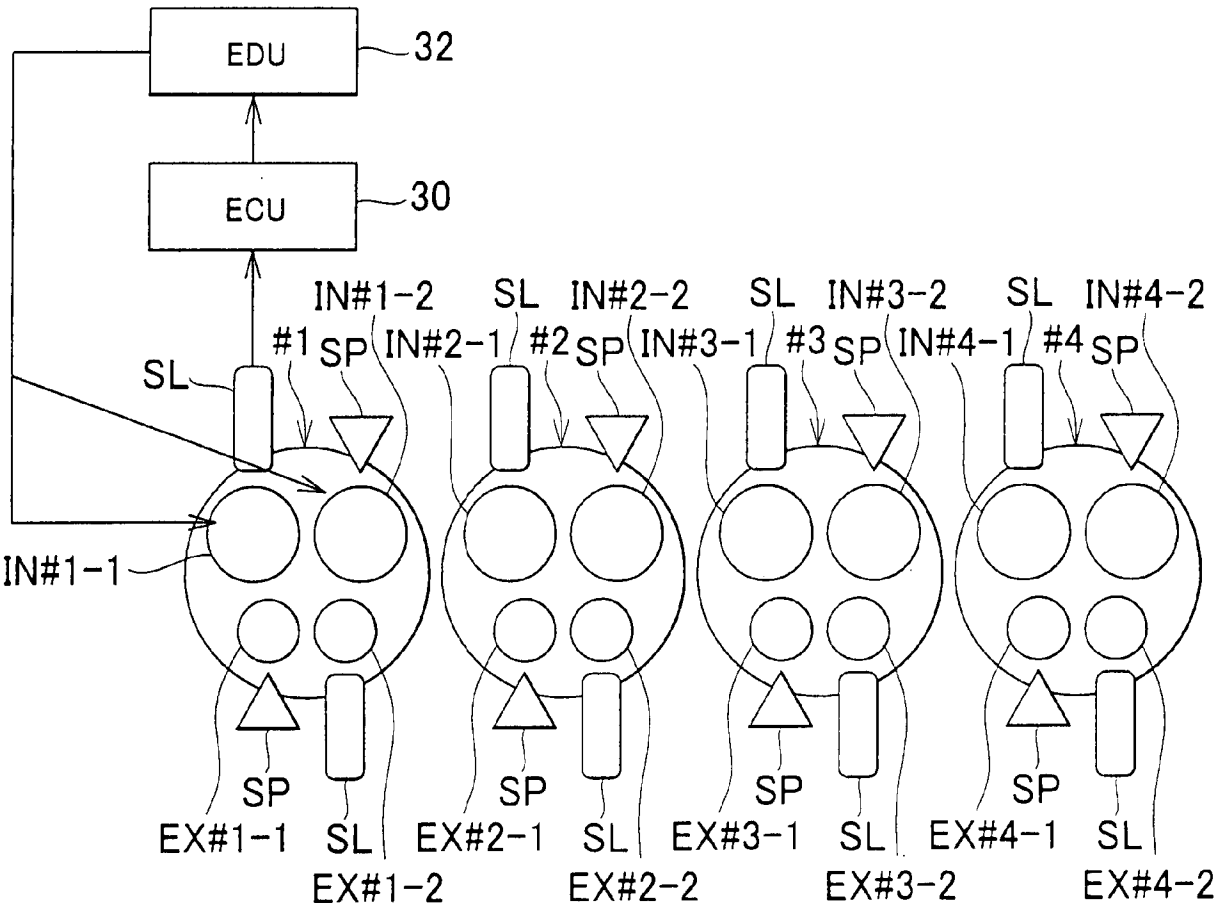
FIG. 2 shows the arrangement of sensors provided with respect to valves according to a first exemplary embodiment of the invention.

FIG. 2 is a view showing the arrangement of sensors provided with respect to valves according to a first exemplary embodiment of the invention.

Referring to the drawing, in the first exemplary embodiment, one lift sensor SL and one proximity sensor SP are provided for each pair of intake valves in each cylinder #1 to #4. Similarly, one lift sensor SL and one proximity sensor SP are provided for each pair of exhaust valves in each cylinder #1 to #4.

That is, in each of cylinders #1, #2, #3, and #4, a lift sensor SL is provided for each of intake valves IN #1-1, #2-1, #3-1, and #4-1 and a proximity sensor SP is provided for each of intake valves IN #1-2, #2-2, #3-2, and #4-2. Also, a proximity sensor SP is provided for each of exhaust valves EX #1-1, #2-1, #3-1, and #4-1 and a lift sensor SL is provided for each of exhaust valves EX #1-2, #2-2, #3-2, and #4-2.

The internal combustion engine thus includes a plurality of valves, including a main driving intake valve IN #1-1 and a driven intake valve IN #1-2, each of which is lifted in response to a signal from the ECU 30, and a lift sensor SL that detects the lift amount of the main driving intake valve IN #1-1. The ECU 30 controls the lift of the main driving intake valve IN #1-1 and the driven intake valve IN #1-2 based on the output of the lift sensor SL. The internal combustion engine preferably also includes a proximity sensor SP that detects whether the position of the driven intake valve IN #1-2 is within a predetermined range, and a crank angle sensor that detects the crank angle. The ECU 30 monitors the output of the proximity sensor SP to determine whether the driven intake valve IN #1-2 is out of synchronization with respect to the crank angle, and performs initial driving control that initializes the positions of the driven intake valve IN #1-2 and the main driving intake valve IN #1-1 corresponding to the driven intake valve when a loss of synchronization is detected.

In this specification, the term "loss of synchronization" or "out of synchronization" refers to a state in which an armature in an electromagnetically driven valve is not attracted to the stator such that in normal routine control, control can no longer be carried out. If a loss of synchronization occurs, the armature may return to the middle position, for example, thus rendering the valve unable to close.

Figure 3:
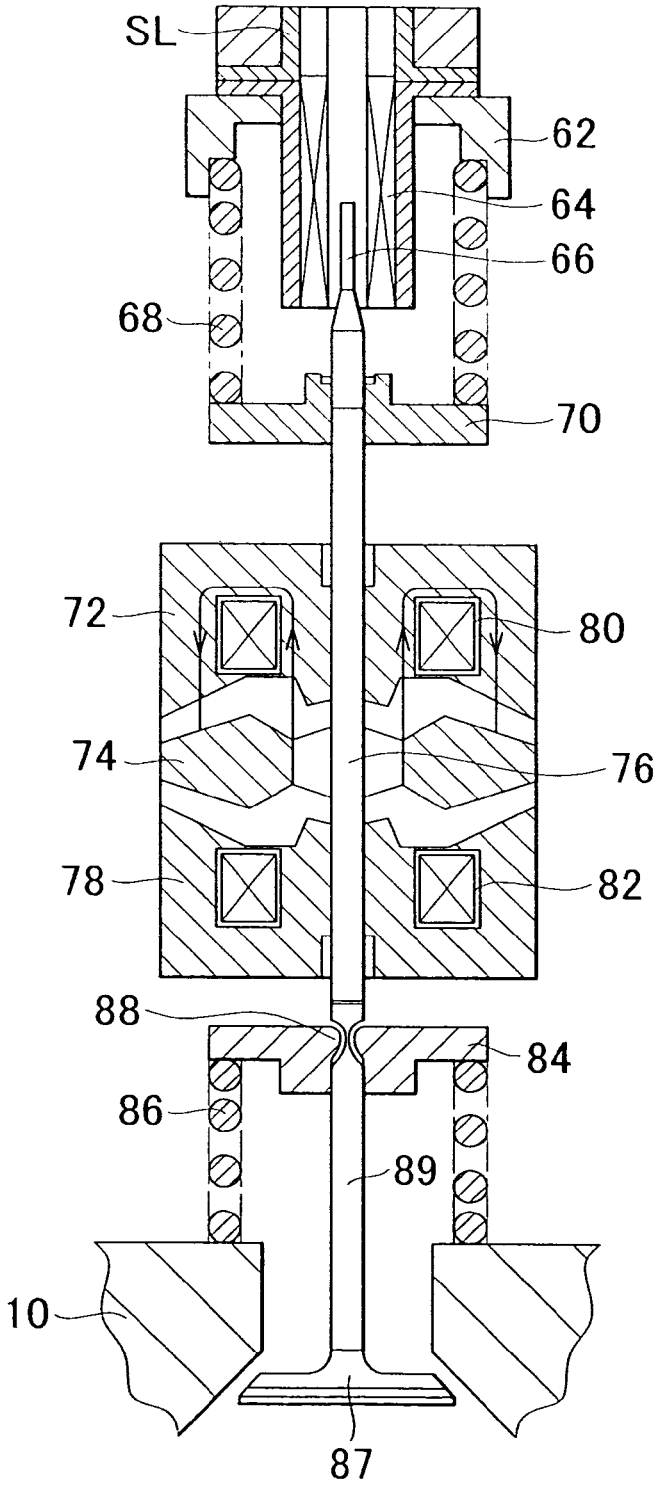
FIG. 3 is a sectional view of the structure of an electromagnetically driven valve with a lift sensor.

FIG. 3 is a sectional view of the structure of an electromagnetically driven valve with a lift sensor. Referring to the drawing, a valve 87 opens and closes an intake port or exhaust port provided in the cylinder head 10 by lifting up and down. An armature shaft 76 is provided on an upper portion of a valve shaft 89 that extends upwards from the valve 87.

A metal rod 66 which is part of the lift sensor SL is connected to the upper part of the armature shaft 76. A plunger 74 is fixed to the center portion of the armature shaft 76. This plunger 74 is arranged between an upper electromagnetic coil 80 that includes an upper core 72 and a lower electromagnetic coil 82 that includes a lower core 78.

The upper core 72 and the lower core 78 are fixed relative to the cylinder head 10. Attraction force (electromagnetic force) from the magnetic force of the upper and lower electromagnetic coils 80 and 82 acts on the plunger 74 to move it up and down.

An upper retainer 70 is fixed to the armature shaft 76 above the upper core 72, and a lower retainer 84 is fixed to the valve shaft 89 below the armature shaft 76.

A spring 68 is interposed between the upper retainer 70 and a sensor housing flange 62, and a spring 86 is interposed between the lower retainer 84 and the cylinder head 10.

The spring 68 and the spring 86 are both retained in a compressed state. The valve 87 is adjusted to a position halfway between fully open and fully closed when the forces of the springs are balanced.

The valve shaft 89 and the armature shaft 76 abut against one another when the valve is open and in the middle position. When the valve is closed, however, there is a slight gap in between the two.

As the resultant force of the springs 68 and 86, a force is generated in the direction that opens the valve when the valve 87 is fully closed, and conversely, a force is generated in the direction that closes the valve when the valve 87 is fully open. Using springs 68 and 86 enables smaller electromagnets to be used when the plunger 74 and the coils 80 and 82 of the electromagnets are separated by a large distance because the force from the springs 68 and 86 compensates for the reduction in electromagnetic force resulting from the use of smaller electromagnets.

The metal rod 66 provided on the upper end of the armature shaft 76 is inserted into the center of a coil 64 provided in a housing of the lift sensor SL so as not to contact the coil 64. The amount of the metal rod 66 that is inserted into the coil 64 changes as the armature shaft 76 moves up and down.

In the electromagnetically driven valve structured as described above, the valve 87 is halfway open when current is not flowing through the upper and lower electromagnetic coils 80 and 82. When a driving current flows through the upper electromagnetic coil 80, the resultant attraction force pulls the plunger 74 up, which closes the valve 87. Conversely, when driving current flows through the lower electromagnetic coil 82, the resultant attraction force pulls the plunger 74 down, which opens the valve 87.

The amount of the metal rod 66 that is inserted into the coil 64 changes as the plunger 74 moves up and down, and the inductance of the coil 64 changes according to how much of the metal rod 66 is inserted into the coil 64. Therefore, if the change in inductance is known, it is possible to detect how much of the metal rod 66 is inserted into the coil 64, which means it is possible to detect the lift amount of the valve 87.

The lift amount detected by the lift sensor SL is fed back to the ECU 30 in FIG. 2. The ECU 30 determines the amount of current that should be supplied to the upper and lower magnetic coils 80 and 82, and then instructs the EDU 32 to supply the determined amount of current to the upper and lower electromagnetic coils 80 and 82 according to that lift amount.

Figure 4:
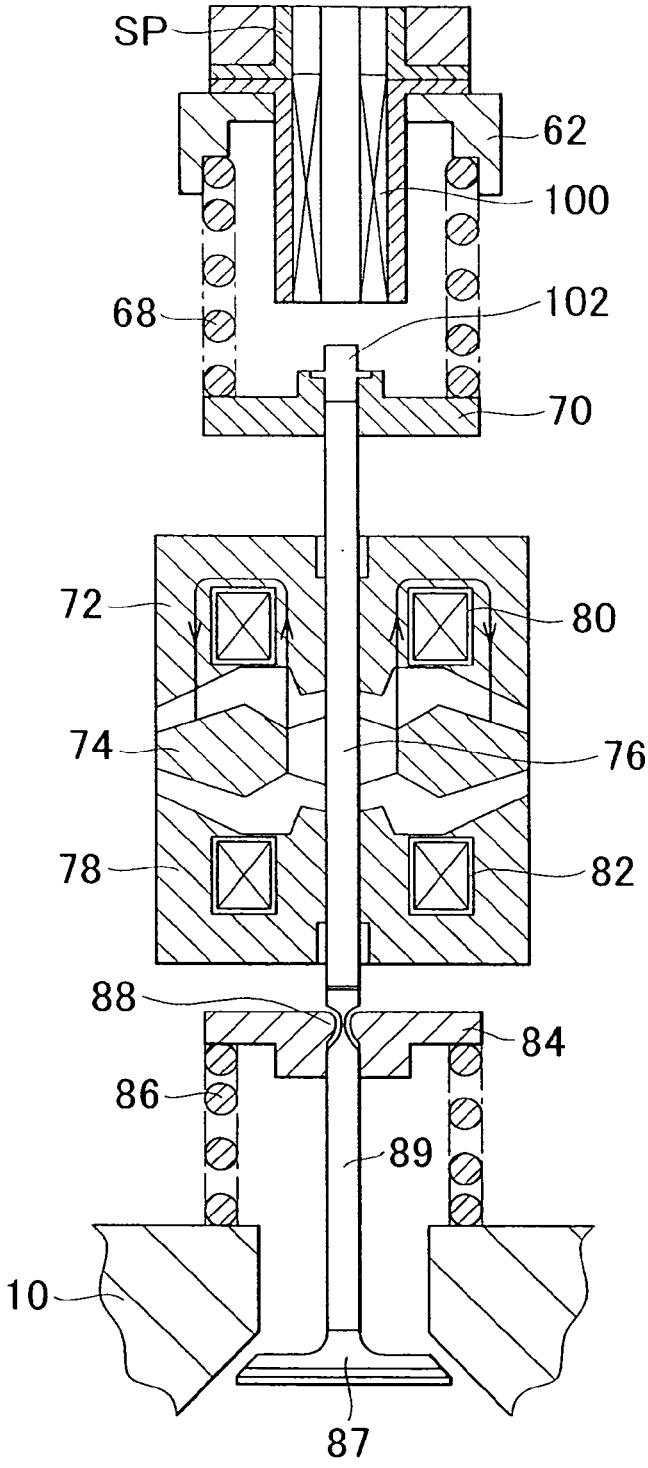
FIG. 4 is a sectional view of the structure of an electromagnetically driven valve with a proximity sensor.

FIG. 4 is a sectional view of the structure of an electromagnetically driven valve with a proximity sensor. Referring to the drawing, the structure of this electromagnetically driven valve differs from the structure of the electromagnetically driven valve shown in FIG. 3 in that a proximity sensor SP is provided instead of the lift sensor SL. The structures of the other portions are similar so the descriptions thereof will not be repeated.

In place of the metal rod 66 shown in FIG. 3 provided on the upper portion of the armature shaft 76, the electromagnetically driven valve shown in FIG. 4 has a metal rod 102 provided on top of the armature shaft 76. The length of this metal rod 102 is such that the metal rod 102 does not contact the surface of the proximity sensor SP. The proximity sensor SP includes a coil 100 instead of the coil 64 in FIG. 3. Because the metal rod 102 is not inserted into the coil 100, a hole for inserting the metal rod is not provided in the surface portion of the proximity sensor SP, which is different from the lift sensor SL.

In the proximity sensor SP shown in the example in FIG. 4, when the metal rod 102 comes near the oscillating coil 100, an eddy current is generated on the surface of the metal rod 102, and the influence of electromagnetic induction causes the impedance of the detection coil 100 to change. It is by the change in impedance that the proximity of the metal rod 102 is detected.

Unlike the lift sensor SL, however, the proximity sensor SP is not able to detect the amount of displacement of the armature shaft, and only detects whether or not the lift of the armature shaft 76 is equal to or greater than a set amount. However, the proximity sensor SP is less expensive than the lift sensor SL.

Accordingly, lift sensors are not provided for all of the valves. Instead, one lift sensor is provided for each pair of valves that move simultaneously, as shown in FIG. 2, and a proximity sensor is provided for each valve of the pair that is not provided with the lift sensor. The proximity sensor detects a disturbance in the synchronization of the two valves, and if a loss of synchronization occurs, the initial control is performed to return the two valves to a synchronized operating state. The main driving valve and the driven valve do not need to be in complete synchronization. No problems are caused if they are slightly out of synchronization with each other.

As an example, the intake valve of cylinder #1 will now be described with reference to FIG. 4. The lift amount of the intake valve IN #1-1 is detected by the lift sensor SL, and the two intake valves IN #1-1 and IN #1-2 which move simultaneously are controlled based on that detected lift amount.

The intake valves in the other cylinders #2 to #4 are also controlled in the same manner, as are the exhaust valves.

Figure 5:
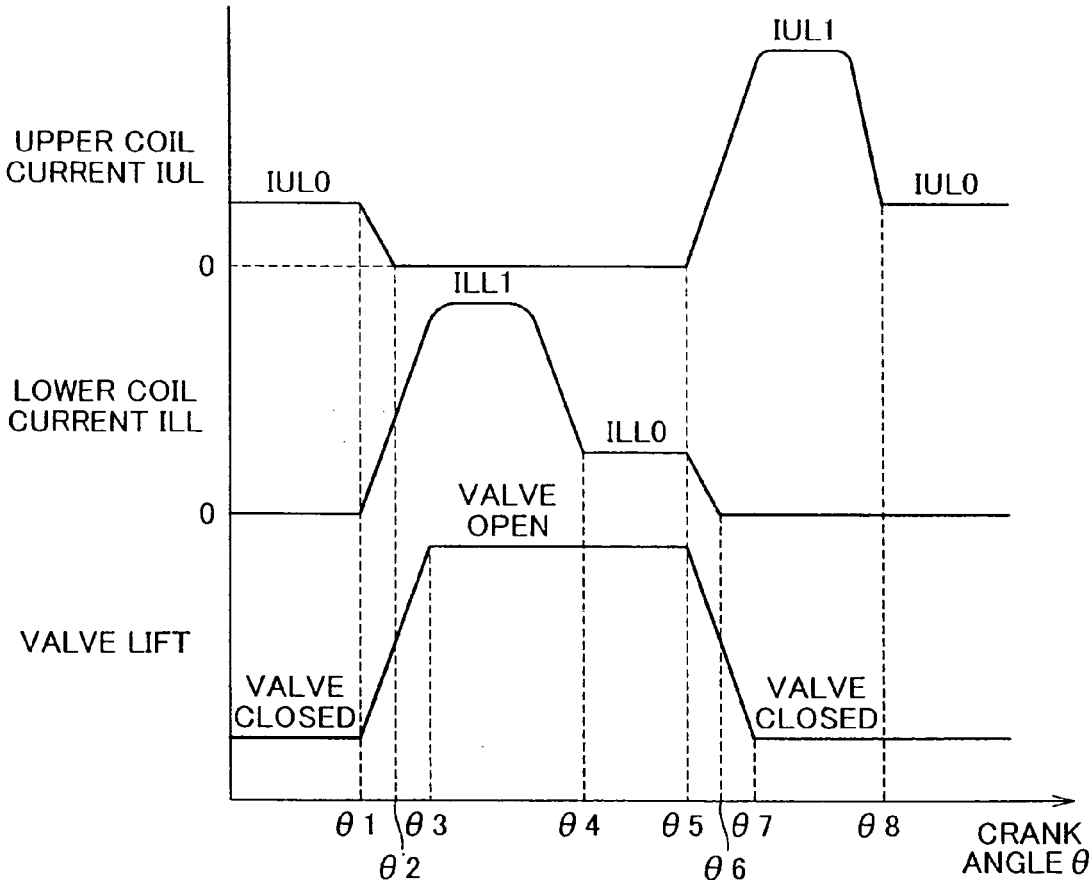
FIG. 5 is a waveform diagram illustrating the relationship between the current flowing through a lower coil and an upper coil and the valve lift amount.

FIG. 5 is a waveform diagram illustrating the relationship between the current flowing through a lower coil and an upper coil and the valve lift amount.

As can be seen in the drawing, the valve remains closed until the crank angle θ1 by running a current IUL0 through the upper coil. At this time, no current in flowing through the lower coil (i.e., the current in the lower coil is 0).

Then between crank angles θ1 and θ2, the upper coil current is reduced from IUL0 to 0, whereupon the valve is returned to the middle position by the force of the spring. Also, between crank angle θ1 and θ3, the current in the lower coil is increased from 0 to ILL1 so that attraction force is generated in the lower coil. These operations work to open the valve from a closed position.

The electric current value of the lower coil at this time is determined based on the lift amount of the valve detected by the lift sensor. At crank angle θ4 after the valve is completely open, a current ILLO that is just enough to keep the valve open is run through the lower coil in order to conserve power.

Moreover, between crank angles θ5 and θ6, the current in the lower coil is reduced from WLL0 to 0, whereupon the valve is moved from the open position to the middle position by the force of the spring. Also, between crank angles θ5 and θ7, the current in the upper coil is increased from 0 to IUL1 so that attraction force is generated in the upper coil. As a result, the valve moves from the open position to the closed position. If the amount of current in the upper coil is increased too much in this operation, the noise produced when the valve comes into contact with the head increases. To prevent this, the amount of current to be supplied to the upper coil is determined while detecting the valve lift amount with the ECU.

When the crank angle reaches θ8 and it has been sufficiently confirmed that the valve is closed, the current value of the upper coil is reduced from IUL1 to a IUL0, which is a current value that is sufficient to keep the valve closed.

Figure 6:
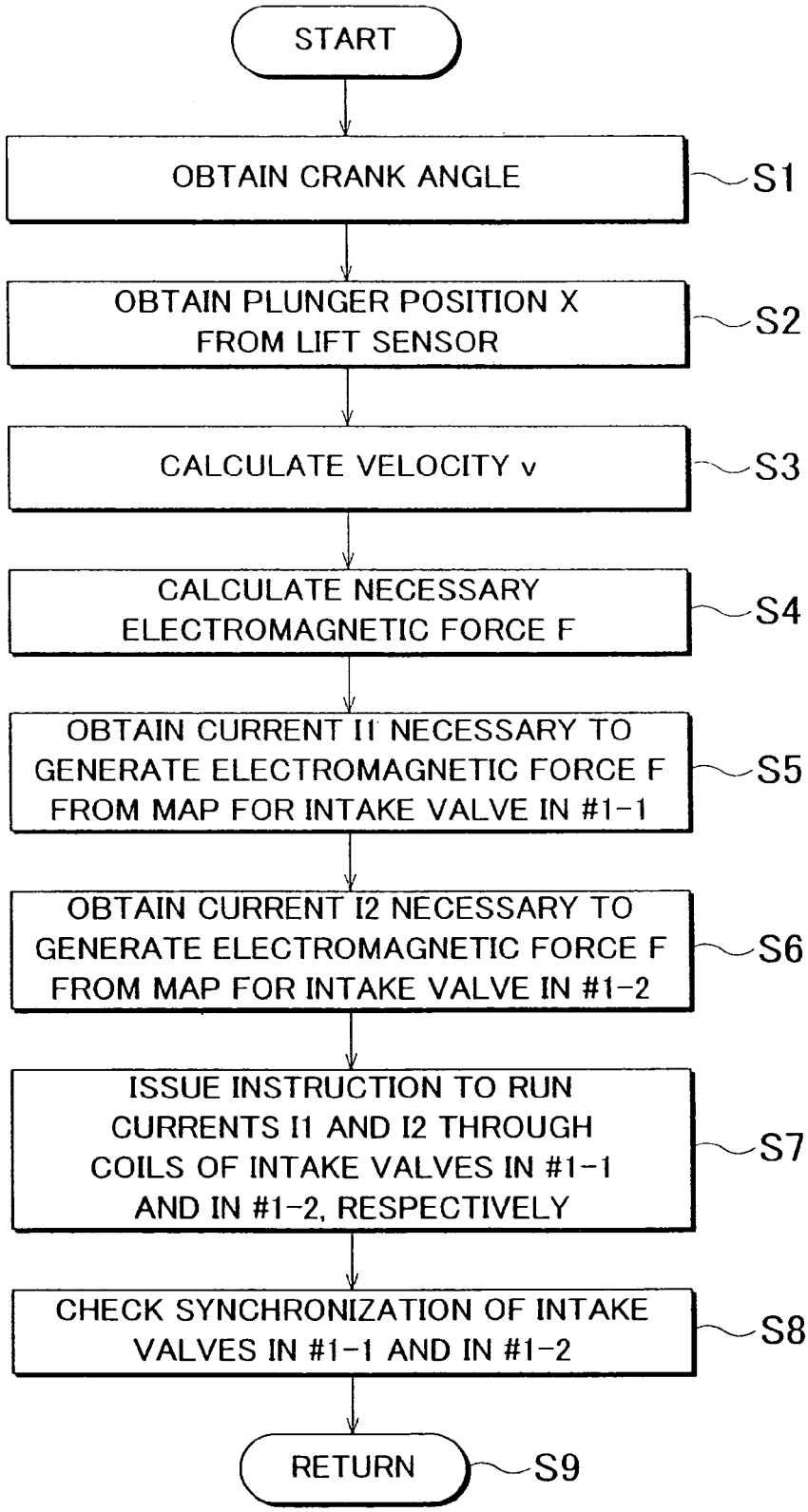
FIG. 6 is a flowchart illustrating the structure of control in a program executed by an ECU shown in FIG. 2.

FIG. 6 is a flowchart illustrating the structure of control in a program executed by the ECU 30 shown in FIG. 2.

The flowchart in FIG. 6 is called up from a predetermined main routine and executed at fixed intervals of time or each time a predetermined condition is satisfied.

Referring to the flowchart, when the routine first starts, in step S1 the ECU 30 obtains the crank angle based on the output of the crank angle sensor 6.

Next in step S2, the ECU 30 obtains a plunger position X from the lift sensor SL. The ECU 30 then calculates the velocity of the plunger v in step S3.

In step S4, the ECU 30 calculates the electromagnetic force F necessary to attract the plunger 74.

Because there is variation in the characteristics of the electromagnets in each electromagnetically driven valve as well as in the clearance between the plunger and the electromagnets in each valve, and the like, the current to be supplied to each valve in order to generate that electromagnetic force F is obtained in the next steps, i.e., steps S5 and S6.

That is, in step S5, a current I1 needed to generate the electromagnetic force F is obtained referencing a map for the intake valve IN #1-1. Similarly in step S6, a current I2 needed to generate the electromagnetic force F is obtained referencing a map for the intake valve IN #1-2.

Figure 7:
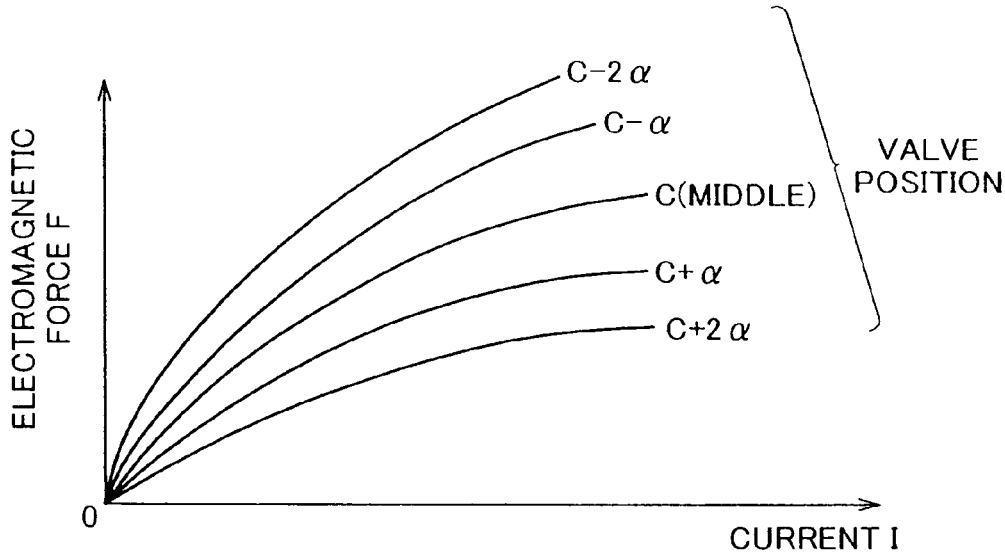
FIG. 7 is a view of an example of an electromagnetic force map provided for each valve.

FIG. 7 is a view of an example of an electromagnetic force map provided for each valve. As shown in the drawing, the relationship between a current I when the lift sensor detects that the valve position is in the middle C and the electromagnetic force F generated when that current I is supplied is stored in the memory 31 shown in FIG. 1. Similarly, maps for when the valve position has changed from the middle position to C+a, C+2a, C−a, C−2a are also stored in the memory 31 in advance.

The data in these maps may be entered into the memory 31 after measuring the characteristics when engine assembly is completed, i.e., after the electromagnetically driven valves have been paired up. Further, data that is measured and supplied in advance for each electromagnetically driven valve unit may also be stored in the memory 31.

Providing an electromagnetic force map such as that shown in FIG. 7 for each valve makes it possible to use the lift amount obtained by the lift sensors in the control of the other electromagnetically driven valves that are provided with the proximity sensors.

Referring back to FIG. 6 again, after obtaining the currents I1 and I2 to be supplied to the coils of the electromagnets in the intake valves in steps S5 and S6, the ECU 30 instructs the EDU 32 to supply those currents I1 and I2 to the coils of the respective intake valves IN #1-1 and IN #1-2 in step S7.

In step S8, the ECU 30 checks whether the intake valves IN #1-1 and IN #1-2 are in sync with each other. This is because it is preferable to check at a given timing whether the intake valve IN #1-2 is operating synchronously with the intake valve IN #1-1 since the lift amount of the intake valve #1-2 is not measured by the lift sensor. Because it is not necessary to perform the process in step S8 for each control cycle, this step may be performed separately from the processes in steps S1 to S7.

After step 8, the routine then proceeds on to step S9, where the control returns to the main routine.

Figure 8:
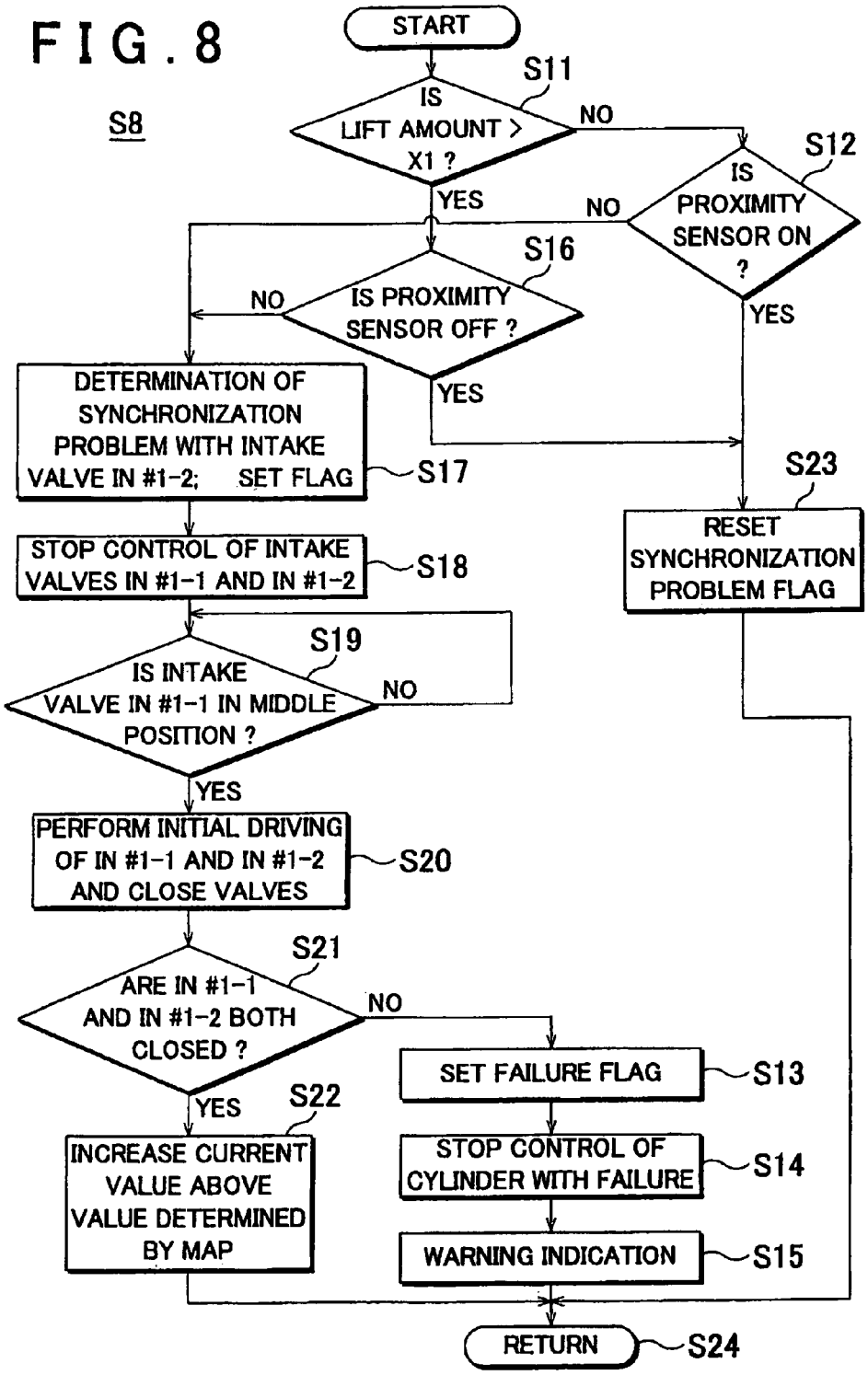
FIG. 8 is a flowchart illustrating the structure of control in a synchronization check routine for an intake valve of step S8 in FIG. 6.

FIG. 8 is a flowchart illustrating the structure of control in a synchronization check routine for an intake valve of step S8 in FIG. 6.

Figure 9:
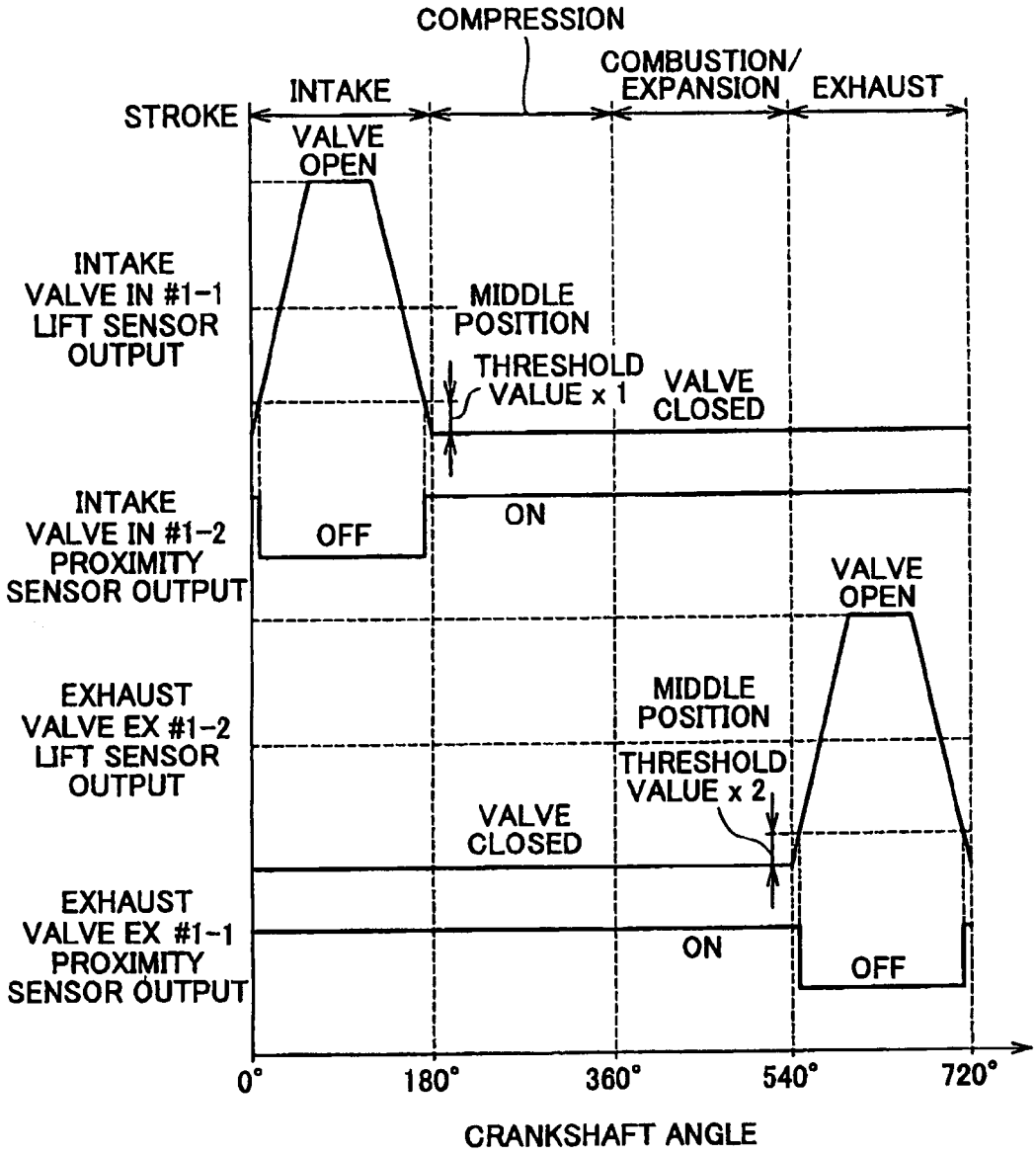
FIG. 9 is a waveform diagram showing the output of a lift sensor and the output of the proximity sensor when the valves are operated based on the control shown in FIG. 6.

FIG. 9 is a waveform diagram showing the output of a lift sensor and the output of the proximity sensor when the valves are operated based on the control shown in FIG. 6

As shown in FIG. 9, during the intake stroke when the crankshaft angle is between 0° and 180°, the intake valve changes from closed to open and then closed again.

If at this time the lift amount is greater than a threshold value X1, the output of the proximity sensor for the intake valve IN #1-2 is off. Here, the lift amount is 0, which serves as the reference point, when the valve is closed and increases as the valve opens.

During the intake stroke, the exhaust valve is closed so a lift amount of 0 is detected and the output of the exhaust valve proximity sensor is on.

During the compression stroke when the crankshaft angle is between 180° and 360°, both the intake valve and the exhaust valve are closed so the output of the lift sensor is lift amount 0 and the output of the proximity sensor is on.

During the combustion and expansion stroke when the crankshaft angle is between 360° and 540°, the lift sensor output is lift amount 0 and the proximity sensor is on, just as in the compression stroke.

During the exhaust stroke when the crankshaft angle is between 540° and 720°, the intake valve is closed so the lift amount of the intake valve is 0 and the output of the proximity sensor is on. Meanwhile, the exhaust valve closes again after being closed and then open. When the lift amount of the exhaust valve exceeds a threshold value X2, the proximity sensor for the exhaust valve turns from on to off, and when the lift amount of the exhaust valve falls below the threshold value X2 again, the output of the proximity sensor turns from off to on again.

When the waveforms are normal, like those shown in FIG. 9, the intake valve IN #1-1 and the intake valve IN #1-2 are presumably operating in synchronization. When a disturbance in this synchronization is detected, the resultant loss of synchronization is detected according to the flowchart in FIG. 8.

Referring to FIG. 8, when the process in step S8 in FIG. 6 starts, it is first determined in step S11 of FIG. 8 whether the lift amount monitored by the lift sensor SL provided for the intake valve IN #1-1 is greater than the threshold value X1.

If the lift amount is greater than the threshold value X1, step S16 is executed. If not step S12 is executed.

In step S12 it is determined whether the output of the proximity sensor provided for the intake valve IN #1-2 is on. If the proximity sensor is not on in step S12, it means, for example, that during the compression stroke in FIG. 9, the intake valve IN #1-1 is closed but the intake valve IN #1-2 is not. In this case, step S17 is then executed.

If, on the other hand, the proximity sensor is on in step S12, it means that, for example, when the intake valve IN #1-1 is closed during the compression stroke in FIG. 9, the intake valve IN #1-2 is also closed. Accordingly, it is determined that the two intake valves are in sync with one another so step S23 is executed.

When the lift amount is greater than the threshold value X1 in step S11 such that step S16 is executed, it is then determined whether the output of the proximity sensor for the intake valve IN #1-2 is off. If the proximity sensor is not off in step S16, it means that the intake valve IN #1-1 is open during the intake stroke in FIG. 9, but the intake valve IN #1-2 is not, so step S17 is then executed.

In step S17, the ECU 30 determines that there is a synchronization problem with the intake valve IN #1-2 and accordingly sets a synchronization problem flag.

Then in step S18, control of the intake valves IN #1-1 and IN #1-2 is stopped. That is, the current flowing through the coils is temporarily reduced to 0 so that the valves temporarily return to the middle position. In step S19, the ECU 30 monitors the output of the lift sensor for the intake valve IN #1-1 and waits until the intake valve IN #1-1 reaches the middle position before proceeding on to the next step. After the intake valve IN #1-1 reaches the middle position, step S20 is executed, where the intake valves IN #1-1 and IN #1-2 are initially driven and closed.

Figure 10:
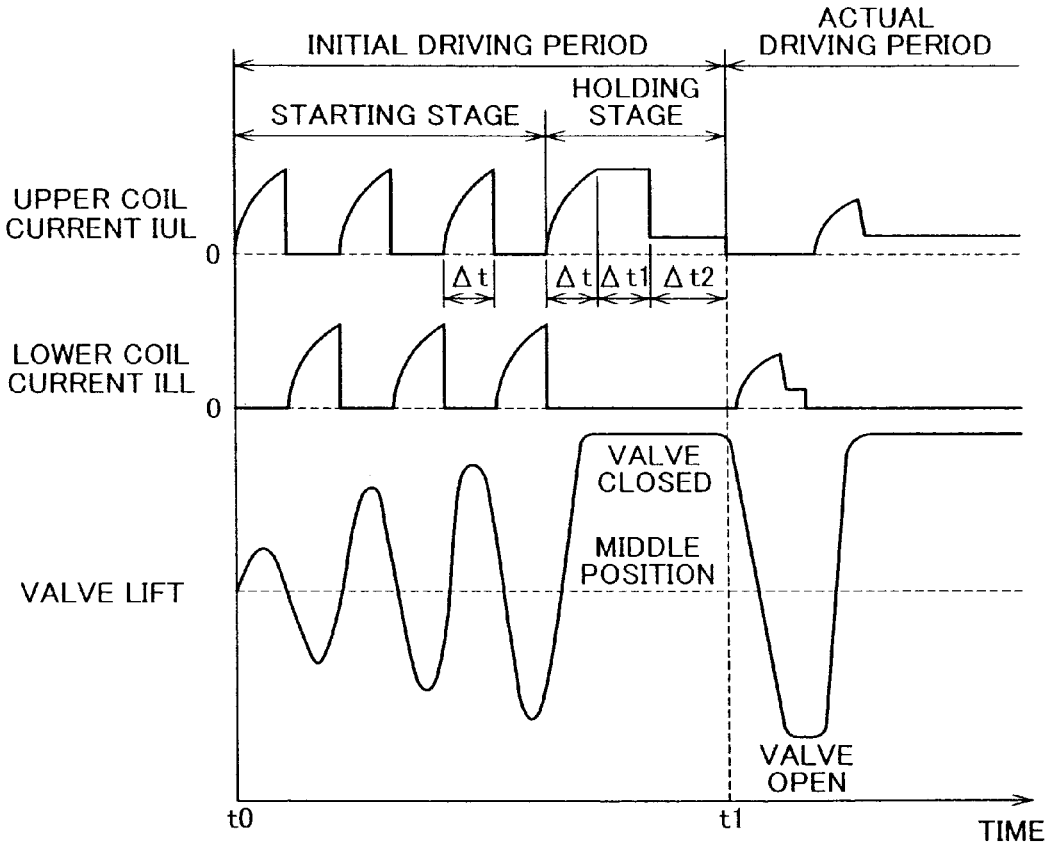
FIG. 10 is a view illustrating initial driving of the electromagnetically driven valve performed in step S20 in FIG. 8.

FIG. 10 illustrates the initial driving of the electromagnetically driven valve that is performed in step S20 in FIG. 8.

In the initial state when the current flowing through the electromagnets is 0, the plunger of the electromagnetically driven valve is in the middle position. In this position, the attraction force of the electromagnets is small in proportion to the square of the distance, which makes it necessary to use unrealistically large electromagnets if trying to attract the stroke amount of the valve with only electromagnetic force.

Therefore, the electromagnetically driven valves shown in FIGS. 3 and 4 use the force of the springs to provide sufficient driving force when the electromagnets and the plunger are separated by a distance. If the size of the electromagnets were reduced to a more realistic size, the current running through the upper and lower coils would not be enough to move the valve from the middle position to the closed position or to keep the valve in the open position, which is why the initial driving such as that shown in FIG. 10 is necessary.

Referring to FIG. 10, at time t0 the valve lift amount is in the middle position. Therefore, in the starting stage which is the first half of the initial driving period, current is supplied alternately to the upper and lower coils in cycles according to the resonant frequency from the springs of the electromagnetically driven valve. This gradually increases the amplitude of the valve lift from the middle position. The valve then closes when the plunger is able to be attracted to the electromagnet, and kept closed during the holding stage which is the latter half of the initial driving period.

At the last part $\Delta t2$ of the holding stage, the minimum current necessary to keep the valve closed is supplied to the upper coil in order to suppress current consumption.

Then in the actual driving period after time t1, the valve is brought from a closed state to an open state by reducing the current in the upper coil to 0 and running current through the lower coil, and brought from an open state to a closed state by reducing the current in the lower coil to 0 and running current through the upper coil.

Referring back to FIG. 8 again, after the intake valves IN #1-1 and IN #1-2 are initially driven in step S20, step S21 is executed, where it is determined whether both of the intake valves IN #1-1 and IN #1-2 are closed. This determination is made by monitoring the lift amount detected by the lift sensor and the output of the proximity sensor.

If it is confirmed in step S21 that the valve is closed, then in step S22 the current value is increased higher than the current value determined by the map shown in FIG. 7 so that a synchronization problem does not occur again. The process in step S22 does not always need to be performed. After step S22, step S2 is executed, where the control returns to the main routine.

If, on the other hand, it is determined in step S21 that one or both of the intake valves IN #1-1 and IN #1-2 are not closed, then step S13 is executed.

In step S13, a failure flag is set. Control of the cylinder in which the failure was determined is then stopped in step S14 and a warning is issued regarding the failure of the electromagnetically driven valve in step S15. This warning may be issued by, for example, illuminating a warning lamp on an instrument panel near the driver's seat.

After step S15, step S24 is executed, where the control returns to the main routine.

If, on the other hand, it is determined in step S16 that the proximity sensor is off, then step S23 is executed.

In step S23, the synchronization problem flag, if set, is reset because the intake valves IN #1-1 and IN #1-2 are in sync with each other. Step S24 is then executed and the control returns to the main routine.

As described above, the first exemplary embodiment makes it possible to reduce manufacturing costs by reducing the number of costly lift sensors used. Moreover, this exemplary embodiment makes it possible to ensure the reliability of engine operation while reducing manufacturing costs.

In the first exemplary embodiment, only two lift sensors are provided for four valves, i.e., one for the two intake valves and one for the two exhaust valves, in each cylinder. A second exemplary embodiment further reduces the number of lift sensors. More specifically, according to the second exemplary embodiment, two lift sensors are provided for eight valves, i.e., one for four intake valves and one for four exhaust valves, in every two cylinders.

Figure 11:
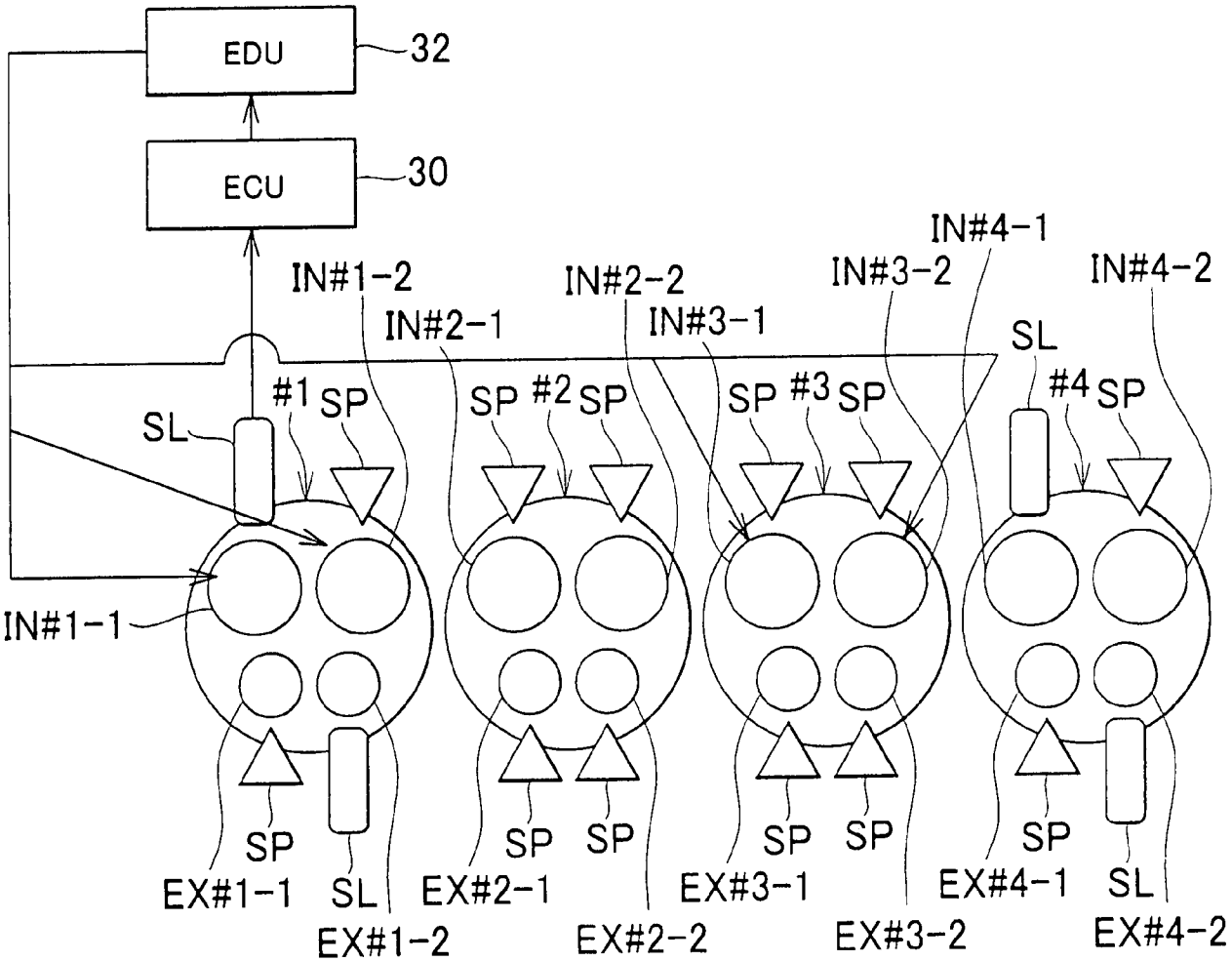
FIG. 11 shows the arrangement of lift sensors according to a second exemplary embodiment of the invention.

FIG. 11 shows the arrangement of lift sensors according to the second exemplary embodiment of the invention. The arrangement shown in FIG. 11 differs from the arrangement shown in FIG. 2 in that the lift sensors SL provided for the intake valves IN #2-1 and IN #3-1 in FIG. 2 are replaced with proximity sensors SP in FIG. 11, and the lift sensors SL provided for the exhaust valves EX #2-2 and EX #3-2 in FIG. 2 are also replaced with proximity sensors SP in FIG. 11. The ECU 30 controls the lift of the four intake valves IN #1-1, IN #1-2, IN #3-1, and IN #3-2 in response to the output of the lift sensor SL provided for the intake valve IN #1-1, as shown by the arrows in FIG. 11.

Although not shown, the ECU 30 also controls the four intake valves IN #2-1, IN #2-2, IN #4-1, and IN #4-2 in response to the output of the lift sensor SL provided for the intake valve IN #4-1.

Also not shown, the ECU 30 also controls the four exhaust valves EX #1-1, EX #1-2, EX #3-1, and EX #3-2 in response to the output of the lift sensor SL provided for the exhaust valve EX #1-2. Similarly, the ECU 30 also controls the four exhaust valves EX #2-1, EX #2-2, EX #4-1, and EX #4-2 in response to the output of the lift sensor SL provided for the exhaust valve EX #4-2.

FIG. 11 shows an example in which a lift sensor is provided for the exhaust valve EX #1-2 and a proximity sensor is provided for the exhaust valve EX #3-2. Alternatively, however, the positioning of the two sensors may be interchanged. That is, cylinders #1 and #3 may be paired up and one lift sensor may be provided for the four intake valves and one provided for the four exhaust valves. The same may also be said for cylinders #2 and #4.

Because the ignition timing of cylinders #1 and #3 is different, however, the ECU 30 must store the lift amounts of valves in the cylinders provided with the lift sensors, and read and use those stored lift amounts according to the crank angle for the cylinders having different ignition timings than the cylinders provided with the lift sensors.

When the firing order of the cylinders is #1→#3→#4→#2, a lift sensor is provided for the cylinder that fires first, among two cylinders with consecutive ignition timings, and the lift amounts detected by the lift sensor during the intake stroke and the exhaust stroke are recorded. The stored lift amounts may be read and used according to the crank angle for the cylinder that fires next. Accordingly, because the firing order is close, disturbances such as fluctuations in engine load would presumably be substantially the same so a decrease in the precision of control can be kept to a minimum.

Further, when lift sensors are provided in cylinders #1 and #4, cylinders #2 and #3 are the cylinders that are not used during reduced-displacement operation such as during two-cylinder operation, so it is possible to keep vibration to a minimum. That is, the firing order of the cylinders during normal operation is #1→#3→#4→#2 so it is preferable to provide lift sensors in cylinders #1 and #4 in order to even out the ignition timing during reduced-displacement operation.

Proximity sensors similar to those shown in FIG. 2 are also used to detect synchronization problems in simultaneously driven valves. The process between the time a synchronization problem occurs until the valves are returned to in-synchronization operation is similar to that illustrated in the first exemplary embodiment. However, in order to prevent a synchronization problem from spreading to other cylinders, when a synchronization problem occurs in cylinder #1, for example, it is preferable to increase the control current beyond the reference value in cylinder #3, which is next in the firing cycle, in order to prevent cylinders #1 and #3 from stopping simultaneously.

Figure 12:
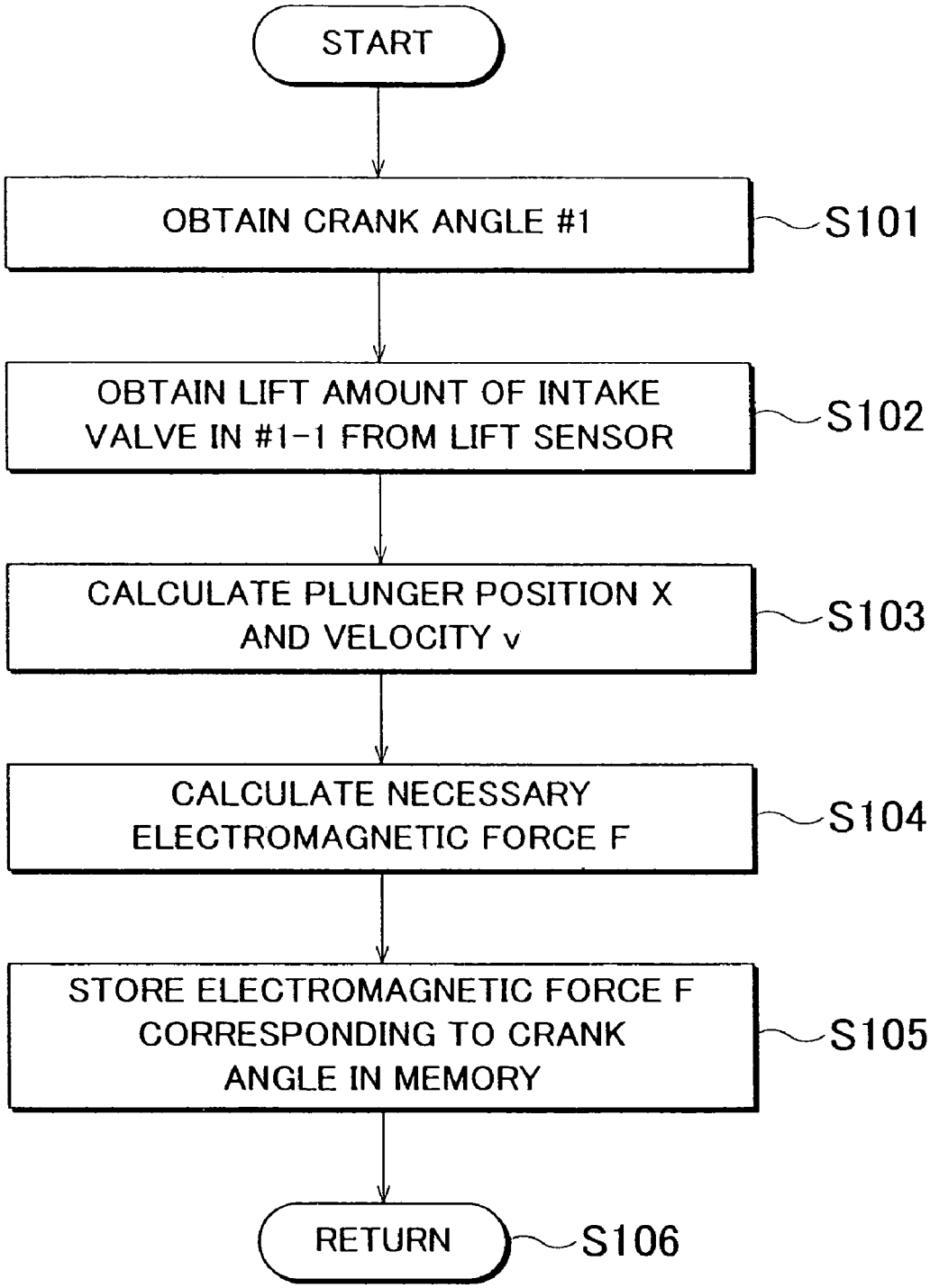
FIG. 12 is a first flowchart illustrating the structure of the control in a program executed by the ECU according to the second exemplary embodiment.

FIG. 12 is a first flowchart illustrating the structure of the control in a program executed by the ECU 30 according to the second exemplary embodiment.

Referring to FIGS. 11 and 12, first when the routine starts, the crank angle of cylinder #1 is obtained in step S101. Then in step S102, the lift amount of the intake valve IN #1-1 is obtained from the lift sensor SL of the cylinder #1.

This lift amount is obtained regularly and in step S103, the velocity v, which is obtained based on the plunger position X and the change over time in that plunger position, is calculated.

Then in step S104, the ECU 30 calculates the necessary electromagnetic force F, and the current amount for the electromagnets in each of the two intake valves of cylinder #1 is determined based on an electromagnetic force map provided for each of those intake valves. Then in step S105, the electromagnetic force F corresponding to the crank angle at that time is stored in the memory 31 in the ECU 30.

Figure 13:
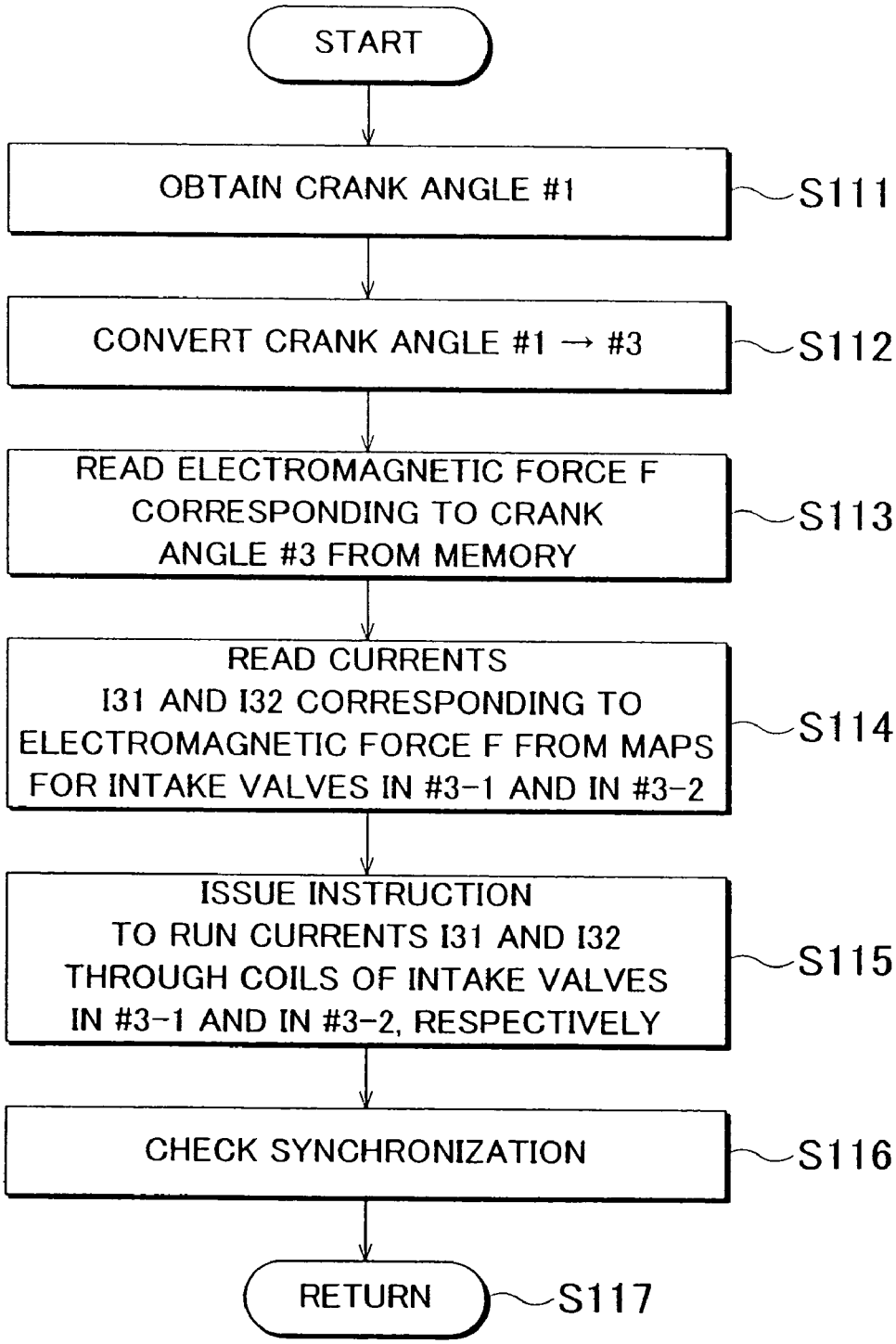
FIG. 13 is a second flowchart illustrating the structure of the control in the program executed by the ECU according to the second exemplary embodiment.

Next, step S106 is executed and the control returns to the main routine. FIG. 13 is a second flowchart illustrating the structure of the control in the program executed by the ECU 30 according to the second exemplary embodiment.

FIG. 13 relates to the control of cylinder #3. Referring to FIGS. 11 and 13, first when the routine starts, the crank angle of cylinder #1 is obtained in step S111. Then in step S112 the crank angle of cylinder #1 is converted into a crank angle of cylinder #3.

Next, in step S113, the ECU 30 reads the electromagnetic force F corresponding to the crank angle of cylinder #3 from the memory 31.

In step Step 114, the ECU 30 reads currents I31 and I32 corresponding to the electromagnetic force F from the electromagnetic force maps for the intake valves IN #3-1 and IN #3-2, respectively. Then in step S115, the ECU 30 instructs the EDU 32 to run the currents I31 and I32 through the coils of the intake valves IN #3-1 and IN #3-2, respectively.

In step S116, synchronization of the valves is checked using the proximity sensor, after which step S117 is executed and the control returns to the main routine.

Figure 14:
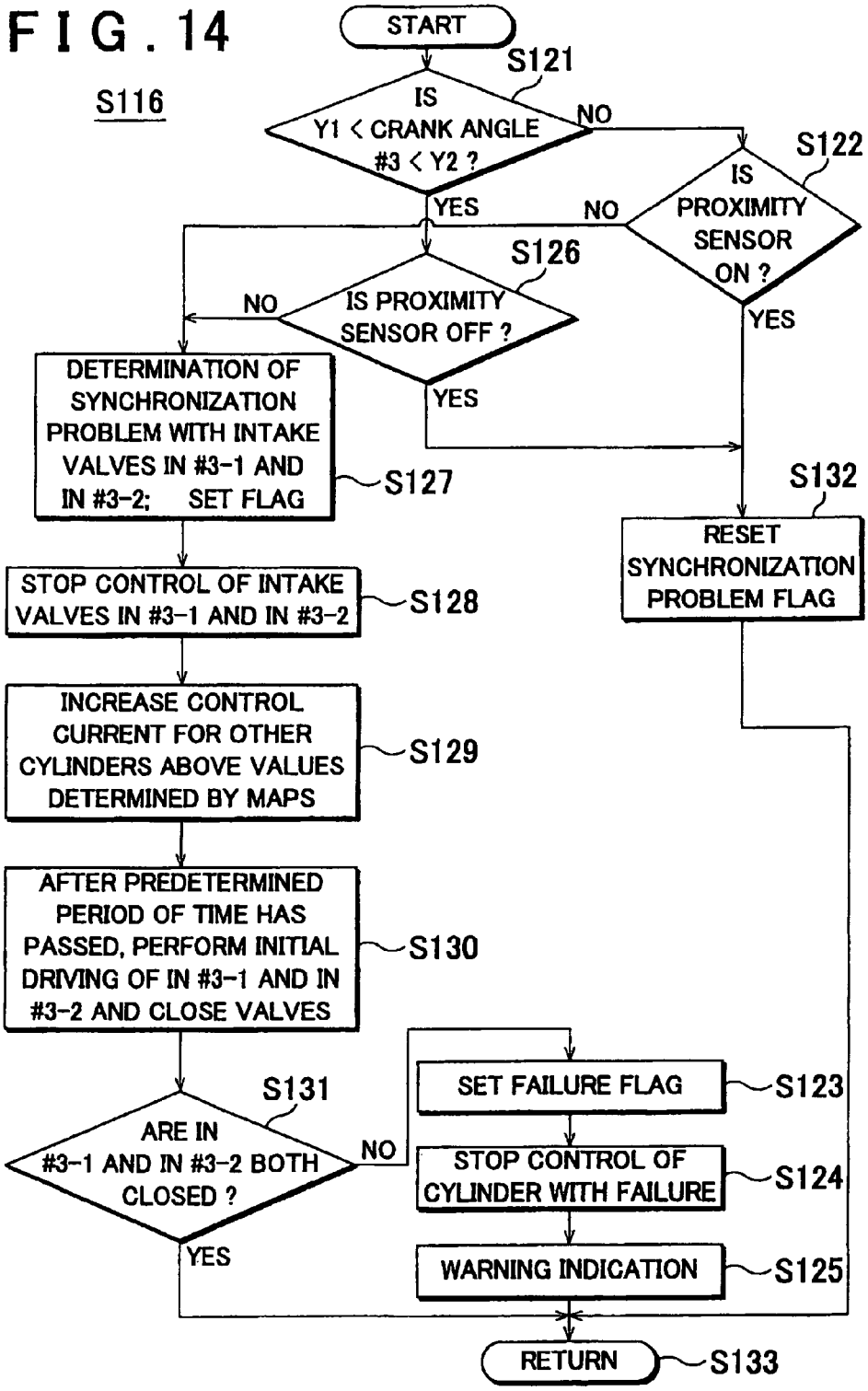
FIG. 14 is a flowchart illustrating the structure of control in a synchronization check routine of step S116 in FIG. 13.

FIG. 14 is a flowchart illustrating the structure of control in a synchronization check routine of step S116 in FIG. 13.

Referring to FIG. 14, when the process in step S116 in FIG. 13 starts, it is first determined in step S121 in FIG. 14 whether the crank angle of cylinder #3 is between crank angle boundary values Y1 and Y2. These crank angle boundary values Y1 and Y2 correspond to crank angles at which the outputs of the proximity sensors change when the intake valves are operating normally, as shown during the intake stroke in FIG. 9.

If the crank angle is not between Y1 and Y2 in step S121, step S122 is then executed. If the crank angle is between Y1 and Y2 in step S121, step S126 is then executed.

If the crank angle is not between Y1 and Y2, i.e., if the process has proceeded onto step S122, then the output of the proximity sensor provided for the intake valve should be on if the intake valve is operating normally. Therefore, in step S122, it is determined whether the output of the proximity sensor is on.

If the output of the proximity sensor is on, it is assumed that the intake valve is operating normally so step S132 is then executed. If, on the other hand, the output of the proximity sensor is not on, step S127 is executed.

If it has been determined in step S121 that the crank angle is between Y1 and Y2 and the process has proceeded on to step S126, the output of the proximity sensor should be off if the intake valve is operating normally. Therefore, in step S126 it is determined whether the proximity sensor is off.

If the proximity sensor is off in step S126, it is assumed that the intake valve is operating normally so step S132 is executed. If, on the other hand, it is determined that the proximity sensor is not off in step S126, then step S127 is executed.

In step S127, it is determined that there is a synchronization problem with the intake valves IN #3-1 and IN #3-2 so the ECU 30 sets the synchronization problem flag. Then in step S128, the ECU 30 stops control of the intake valves IN #3-1 and IN #3-2. That is, the ECU 30 temporarily reduces the current supplied to the electromagnets of the intake valves to 0. In step S129, the control current of the other cylinders is increased a predetermined amount more than the reference values determined by the maps to increase the attraction force of the electromagnets so that a similar synchronization problem does not occur in the other cylinders.

Then in step S130, after a predetermined period of time has passed, during which it is assumed that the intake valves IN #3-1 and IN #3-2 will return to the middle position, the intake valves IN #3-1 and IN #3-2 are initially driven and closed. This initial driving is performed by running currents such as those shown in FIG. 10 through the electromagnetic coils, as described in the first exemplary embodiment.

After step S130, step S131 is executed, in which it is determined whether both of the intake valves IN #3-1 and IN #3-2 are closed. This determination is made by monitoring the lift amount detected by the lift sensor and the output of the proximity sensor.

If it is confirmed that both of the valves are closed in step S131, then the process proceeds on to step S133 where the control returns to the main routine.

If, on the other hand, it is determined in step S131 that either one or both of the intake valves IN #3-1 and IN #3-2 is not closed, then step S123 is executed.

In step S123, the failure flag is set. Then in step S124, control of the cylinder in which the failure has occurred (in the case, cylinder #3) is stopped, while the remaining three cylinders are kept operating. In step S125, the driver is notified of the failure by means of a warning lamp or the like. The process then proceeds on to step S133 where the control returns to the main routine.

When the process has proceeded on to step S132 after it was determined in either step S126 or step S122 that the output of the proximity sensor is normal, the ECU 30 then resets the synchronization problem flag and the process proceeds on to step S133 where the control returns to the main routine.

As described above, the second exemplary embodiment enables the number of lift sensors to be reduced even more.

Figure 15:
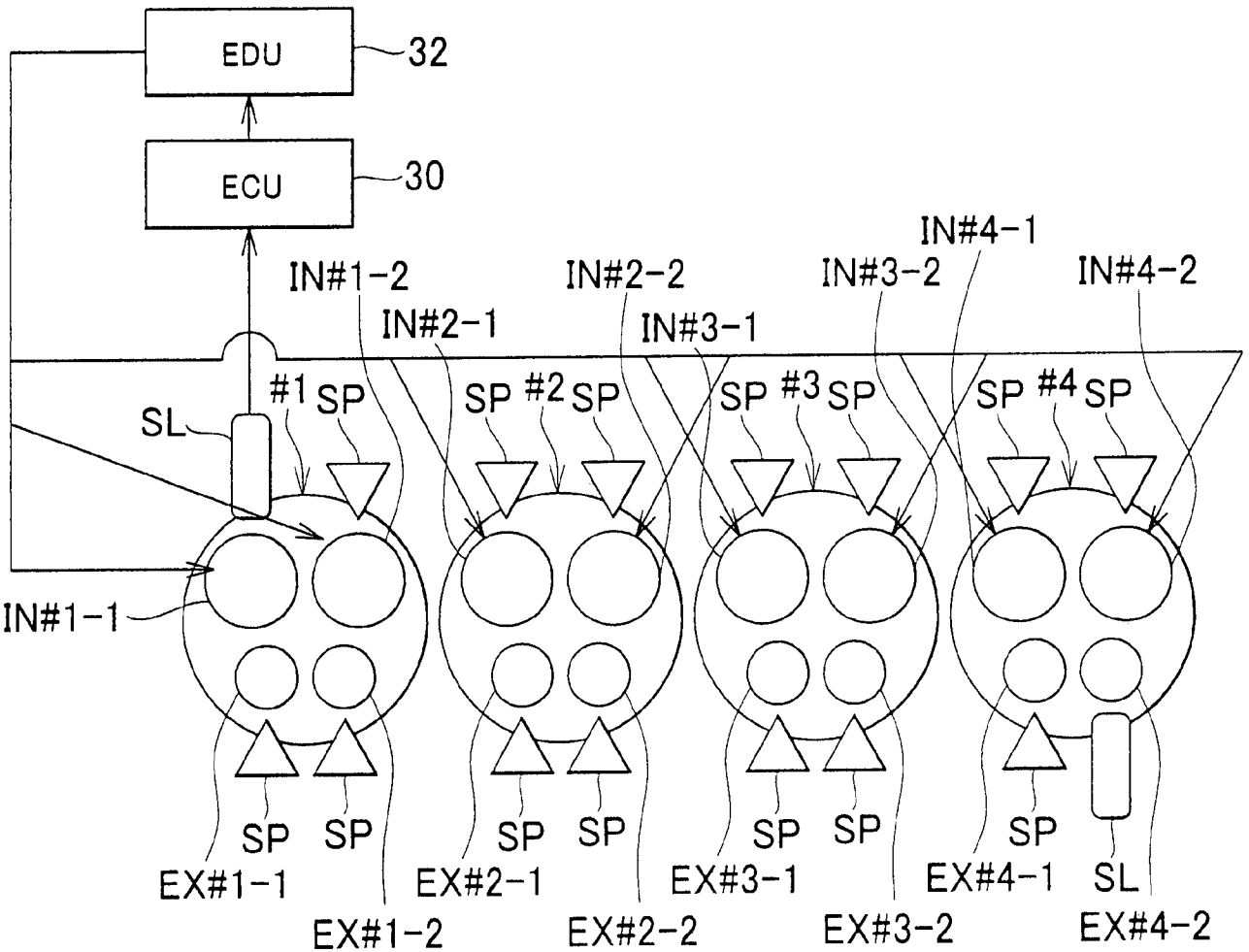
FIG. 15 shows the arrangement of sensors according to a third exemplary embodiment of the invention.

FIG. 15 shows the arrangement of sensors according to a third exemplary embodiment of the invention. As shown in the drawing, the third exemplary embodiment provides one lift sensor on both the intake valve side and the exhaust valve side for every four cylinders. That is, one lift sensor is provided for eight intake valves and one lift sensor is provided for eight exhaust valves.

In a four cylinder engine, as shown in FIG. 15, for example, a lift sensor SL is provided at the intake valve IN #1-1 of cylinder #1 and a lift sensor SL is provided at the exhaust valve EX #4-2 of cylinder #4. Proximity sensors SP are provided for the other intake valves and exhaust valves.

The lift sensors are provided only on cylinders #1 and #4 because cylinders #2 and #3 are the cylinders that would be shut off during reduced-displacement operation, such as two-cylinder operation in order to keep vibration to a minimum. That is, the firing order of the cylinders is #1→#3→#4→#2 so lift sensors are provided for cylinders #1 and #4 in order to even out the ignition timing during reduced-displacement operation.

Alternatively, lift sensors may be provided for cylinders #2 and #3 instead of cylinders #1 and #4. The structure may also be modified such that the lift sensor SL provided for the exhaust valve EX #4-2 of cylinder #4, shown in FIG. 15, is instead provided for the exhaust valve EX #1-2 of cylinder #1.

Illustrating one example of the intake valve, as shown by the arrows in FIG. 15, the output of the lift sensor SL of the intake valve IN #1-1 is input to the ECU 30. The ECU 30 then outputs a signal indicative of a current amount for the eight intake valves IN #1-1, IN #1-2, IN #2-1, IN #2-2, IN #3-1, IN #3-2, IN #4-1, and IN #4-2 to the EDU 32 based on that output.

For cylinders #2, #3, and #4, the lift amount detected by the lift sensor in cylinder #1 is stored in the memory 31 and can be used by retrieving it from memory in response to the crank angle, just as described in the second exemplary embodiment.

In the third exemplary embodiment, the number of lift sensors can be even further reduced, thus enabling even greater cost benefits.

According to a fourth exemplary embodiment of the invention, instead of using lift sensors, cylinder internal pressure sensors are provided and control is performed by detecting disturbances in valve control.

Figure 16:
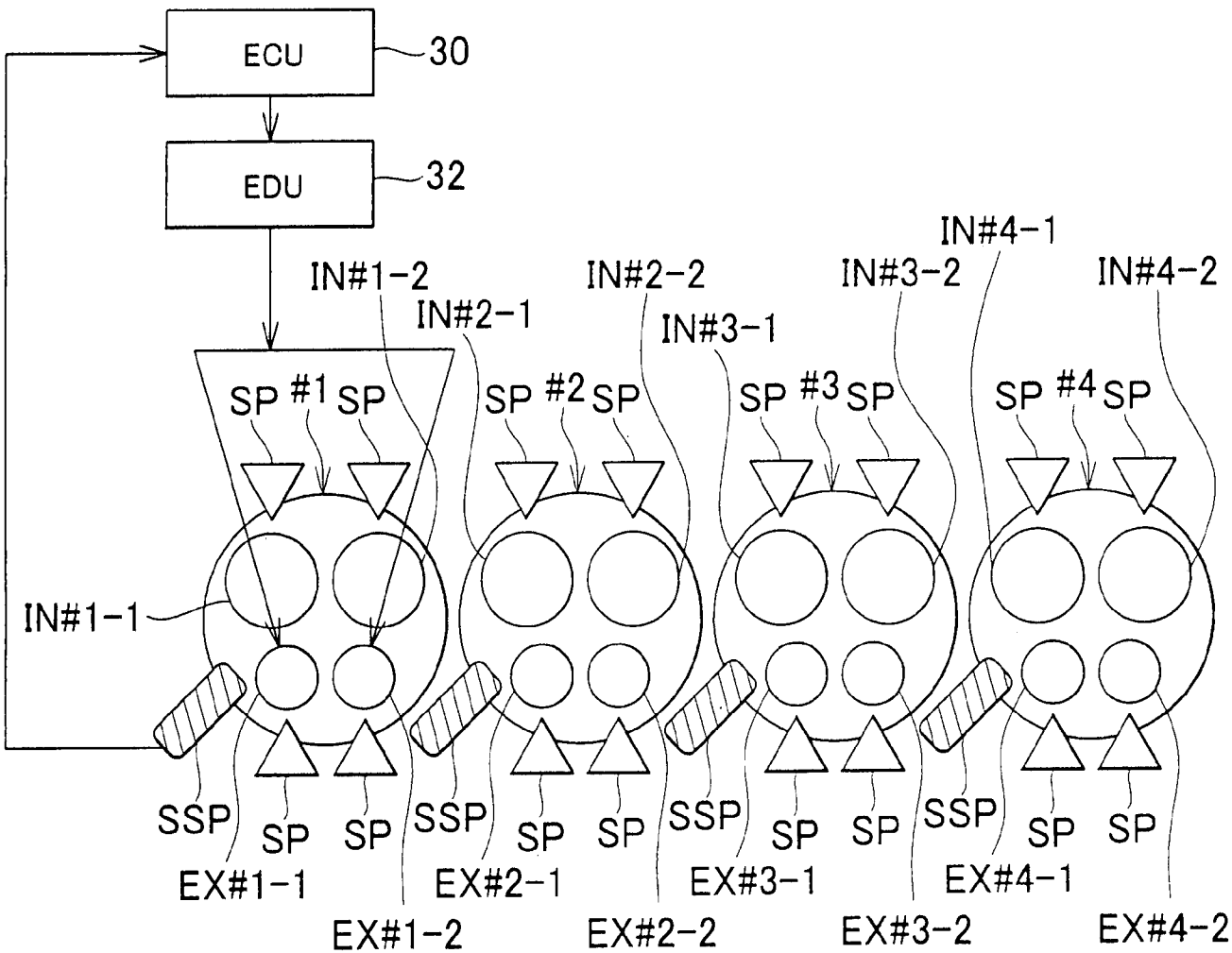
FIG. 16 shows the arrangement of sensors according to a fourth exemplary embodiment of the invention.

FIG. 16 shows the arrangement of sensors according to a fourth exemplary embodiment. As shown in the drawing, proximity sensors SP are provided for the intake and exhaust valves in all the cylinders. In addition, a cylinder internal pressure sensor SSP is provided for each cylinder #1 to #4. In the fourth exemplary embodiment, the exhaust valves are controlled using these cylinder internal pressure sensors SSP instead of lift sensors. Because the intake valves are affected very little by the internal pressure of the cylinders, they are controlled by feed-forward control of only an electromagnetic force characteristic map which specifies the current with respect to the crank angle.

Also, regarding loss of synchronization of the intake and exhaust valves, after detection is performed just as in the first to the third exemplary embodiments using the proximity sensors SP and a loss of synchronization has been detected, the valves that are controlled dependently are also temporarily returned to the middle position and started again simultaneously with the valve that was out of synchronization.

According to the fourth exemplary embodiment, it is possible to control electromagnetic valves without using lift sensors.

Figure 17:
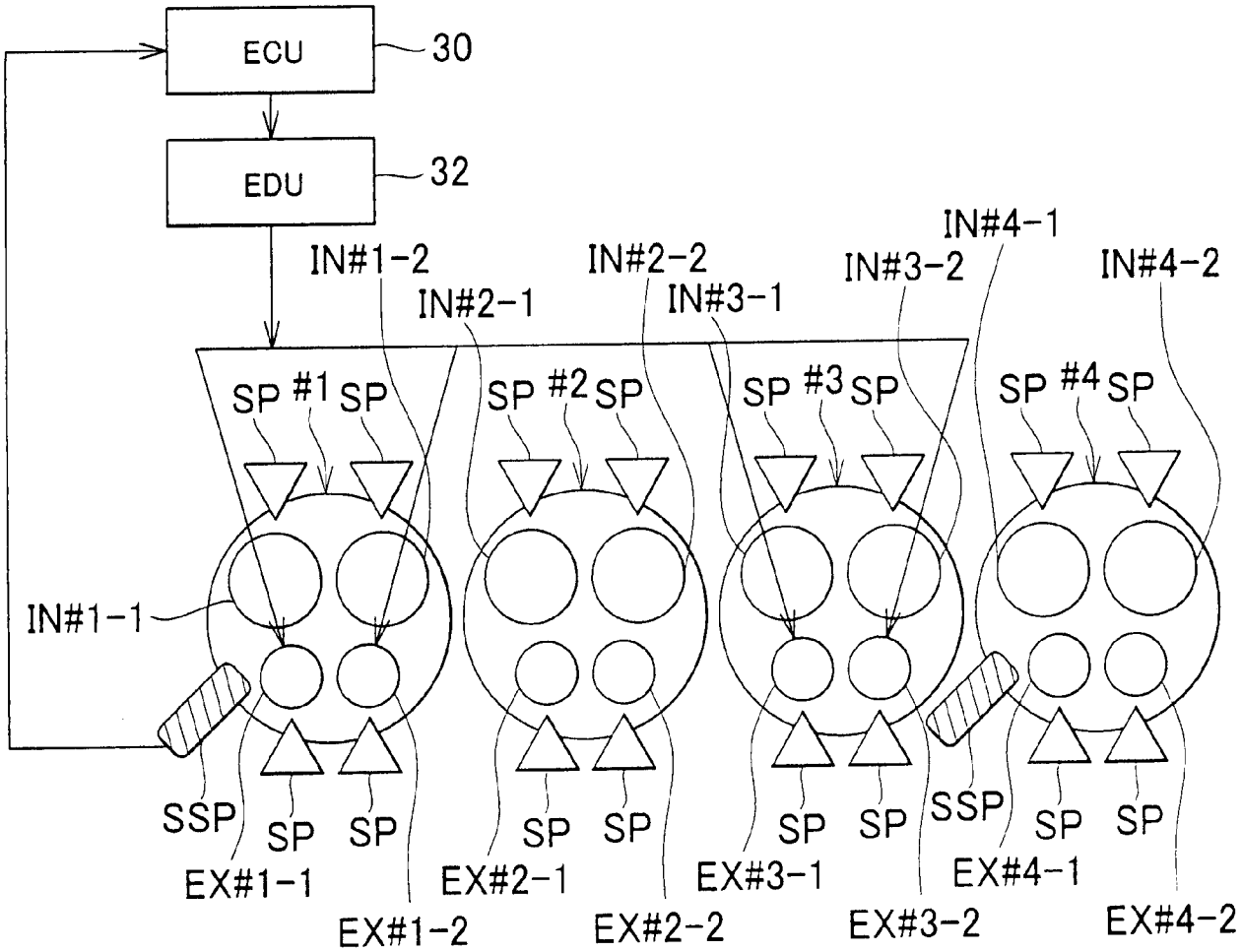
FIG. 17 shows the arrangement of sensors according to a fifth exemplary embodiment of the invention.

FIG. 17 shows the arrangement of sensors according to a fifth exemplary embodiment of the invention. The sensor arrangement shown in FIG. 17 is the same as that shown in FIG. 16, except for without the cylinder internal pressure sensors of cylinders #2 and #3. Instead, the exhaust valves of cylinder #3 are controlled in response to the output of the cylinder internal pressure sensor of cylinder #1, and the exhaust valves of cylinder #2 are controlled in response to the output of the cylinder internal pressure sensor of cylinder #4.

That is, one cylinder internal pressure sensor SSP is provided for every two cylinders. In a four cylinder engine, cylinders #1 and #3 constitute one group and cylinders #2 and #4 constitute another group. Accordingly, for example, the exhaust valves in cylinder #3 are then controlled, for example, with the cylinder internal pressure sensor of cylinder #1. That is, information regarding the cylinder internal pressure during the exhaust stroke and the crank angle of cylinder #1 is stored, and then read from memory and used for cylinder #3 in response to the crank angle during the exhaust stroke of cylinder #3. Cylinder #3 is next after cylinder #1 in the firing order so it is assumed that, because the firing orders are close, any disturbances such as changes in the engine load will be substantially the same. Accordingly, a decrease in control precision can be kept to a minimum.

Loss of synchronization is detected using proximity sensors, just as in the foregoing first to the fourth exemplary embodiments. Returning the valve to normal operation after a loss of synchronization has been detected is also done just as it is in the first to the fourth exemplary embodiments. Also, if, for example, a valve in cylinder #1 has fallen out of synchronization, the control current in the valves in cylinder #3, which is next in the firing order, may be increased to increase the attraction force of the electromagnets so that the loss of synchronization does not spread to other cylinders.

Further, during reduced-displacement operation such as when running on only two cylinders, only the cylinders provided with the cylinder internal pressure sensors, i.e., only cylinders #1 and #4, are operated while cylinders #2 and #3 are not. Selecting the cylinders to be operated in this way enables the ignition cycles during reduced-displacement operation to be uniform, thus enabling vibration to be kept to a minimum.

Compared with the fourth exemplary embodiment, the fifth exemplary embodiment enables the number of cylinder internal pressure sensors to be reduced even further, which in turn reduces production costs.

While the invention has been described with reference to exemplary embodiments thereof, it is to be understood that the invention is not limited to the exemplary embodiments or constructions. To the contrary, the invention is intended to cover various modifications and equivalent arrangements. In addition, while the various elements of the exemplary embodiments are shown in various combinations and configurations, which are exemplary, other combinations and configurations, including more, less or only a single element, are also within the spirit and scope of the invention.

What is claimed is:

1. A control apparatus for an internal combustion engine provided with a plurality of valves, including a main driving valve and a driven valve, each of which can be lifted, and a lift sensor that detects a lift amount of the main driving valve, comprising:

a controller that controls the lift of the main driving valve and the driven valve based on an output of the lift sensor;

a proximity sensor, which detects whether the position of the driven valve is within a predetermined range;

a crank angle sensor, which detects a crank angle, wherein the controller monitors the output of the proximity sensor to determine whether the driven valve is out of synchronization with respect to the crank angle, and performs an initial driving control, which initializes the positions of the driven valve and the main driving valve corresponding to the driven valve, when loss of synchronization is detected.

2. The control apparatus for an internal combustion engine according to claim 1, wherein the controller increases the driving force of at least one of the main driving valve and the driven valve when loss of synchronization is detected.

3. The control apparatus for an internal combustion engine according to claim 1, further comprising:

a crank angle sensor which detects a crank angle;

wherein the main driving valve and the driven valve are provided in different cylinders from among a plurality of cylinders of the internal combustion engine, and the controller stores data indicative of the relationship between the crank angle of the cylinder provided with the main driving valve and the change in the lift amount of the main driving valve, and controls the driven valve based on the stored data.

4. The control apparatus for an internal combustion engine according to claim 3, wherein the plurality of cylinders includes a first cylinder and a second cylinder having consecutive firing orders; and the main driving valve is provided for the first cylinder and the driven valve is provided for the second cylinder.

5. The control apparatus for an internal combustion engine according to claim 3, wherein the plurality of cylinders includes a first cylinder that continues to fire during reduced-displacement operation of the internal combustion engine, in which a number of the plurality of cylinders are shut off, and a second cylinder that does not fire during reduced-displacement operation; and the main driving valve is provided for the first cylinder and the driven valve is provided for the second cylinder.

6. The control apparatus for an internal combustion engine according to claim 1, wherein the main driving valve includes a main driving intake valve and a main driving exhaust valve;

the driven valve includes a driven intake valve and a driven exhaust valve that correspond to the main driving intake valve and the main driving exhaust valve, respectively;

the lift sensor includes an intake valve lift sensor provided at the main driving intake valve and an exhaust valve lift sensor provided at the main driving exhaust valve; and the driven intake valve is controlled in response to the intake valve lift sensor and the driven exhaust valve is controlled in response to the exhaust valve lift sensor.

7. A control apparatus for an internal combustion engine provided with a plurality of valves, each of which can be lifted, and a pressure sensor which detects an internal pressure of a cylinder, comprising:

a controller which controls at least one valve, from among the plurality of valves, to lift based on an input of the pressure sensor, wherein the internal combustion engine includes a plurality of cylinders including a first cylinder and a second cylinder having consecutive firing orders; the pressure sensor detects the internal pressure of the first cylinder and the controller controls the lift of a valve provided for the first cylinder and a valve provided for the second cylinder, from among the plurality of valves, based on the output of the pressure sensor.

* * * * *

UNITED STATES PATENT AND TRADEMARK OFFICE

CERTIFICATE OF CORRECTION

PATENT NO. : 7,406,931 B2
APPLICATION NO. : 11/437749
DATED : August 5, 2008
INVENTOR(S) : Kiyoharu Nakamura It is certified that error appears in the above-identified patent and that said Letters Patent is hereby corrected as shown below:

| Column | Line | |
|---|---|---|
| 2 | 58 | After "intake port" insert --**11**--. |
| 5 | 59 | Change "WLL**0**" to --ILL**0**--. |

Signed and Sealed this

Twenty-sixth Day of May, 2009

JOHN DOLL
*Acting Director of the United States Patent and Trademark Office*